US007284747B2

(12) United States Patent
Fiedler et al.

(10) Patent No.: US 7,284,747 B2
(45) Date of Patent: Oct. 23, 2007

(54) POLYGON SHAPED FLUID DIFFUSER

(75) Inventors: Lon W. Fiedler, St. Paul, MN (US); Brian P. Kelley, Lake Elmo, MN (US); Emily J. Kraft, St. Paul, MN (US)

(73) Assignee: Toltz, King, Duvall, Anderson and Associates, Incorporated, Saint Paul, MN (US)

( * ) Notice: Subject to any disclaimer, the term of this patent is extended or adjusted under 35 U.S.C. 154(b) by 407 days.

(21) Appl. No.: 10/900,520

(22) Filed: Jul. 28, 2004

(65) Prior Publication Data

US 2005/0023382 A1 Feb. 3, 2005

Related U.S. Application Data

(60) Provisional application No. 60/490,646, filed on Jul. 28, 2003.

(51) Int. Cl.
*B01F 3/04* (2006.01)

(52) U.S. Cl. ..... 261/122.1; 261/124; 239/565

(58) Field of Classification Search ..... 261/121.1, 261/122.1, 122.2, 124; 239/558, 565
See application file for complete search history.

(56) References Cited

U.S. PATENT DOCUMENTS 1,653,454 A * 12/1927 Frattallone ..... 261/124
2,050,117 A * 8/1936 Page ..... 261/124
3,271,304 A * 9/1966 Valdespino et al. ..... 210/621
3,785,779 A * 1/1974 Li et al. ..... 422/231
3,889,639 A * 6/1975 Day et al. ..... 119/211
3,998,394 A 12/1976 Ovard
4,549,997 A * 10/1985 Verner et al. ..... 261/77
4,928,854 A 5/1990 McCann et al.
RE33,899 E 4/1992 Tyer
5,590,979 A 1/1997 Sullivan et al.
5,816,497 A 10/1998 Leon et al.
6,033,562 A * 3/2000 Budeit ..... 210/199
6,360,970 B1 3/2002 Fitzgerald
2003/0001291 A1* 1/2003 Stevens ..... 261/77

OTHER PUBLICATIONS

Charles E. Dorgan, Ph.D., P.E. et al., *Design Guide for Cool Thermal Storage*, 1993.

Lon W. Fiedler et al., *Chilled Water Storage Tank Piping Plan and Details*. 2004.

* cited by examiner

*Primary Examiner*—Scott Bushey
(74) *Attorney, Agent, or Firm*—Kinney & Lange, P.A.

(57) ABSTRACT

A plurality of pipe diffuser sections are arranged in a three to seven sided polygon, which allows a fluid to flow through distribution piping and the pipe sections and diffuse, through openings in the walls of the pipe diffuser sections, into a body of fluid contained in a tank.

20 Claims, 7 Drawing Sheets

POLYGON SHAPED FLUID DIFFUSER

CROSS-REFERENCE TO RELATED APPLICATION(S)

This application claims the benefit of the filing date of U.S. provisional application Ser. No. 60/490,646, entitled "POLYGON SHAPED FLUID DIFFUSER" which was filed Jul. 28, 2003 by L. Fiedler, B. Kelley and E. Kraft, and is hereby incorporated by reference.

BACKGROUND OF THE INVENTION

The present invention relates to devices for conveying fluid, and more particularly to devices for diffusing fluid into a body of fluid.

A stratified chilled water storage tank simultaneously stores warm water and cool water in a single body of water. The tank maintains the warm water and the cool water as two separate temperature zones. The upper portion of the tank contains a warm water zone. The lower portion of the tank contains a cool water zone. The warm water tends to stay in the upper portion because it is less dense, while the cool water tends to stay in the lower portion because it is more dense.

The separation of the warm water zone and the cool water zone is called stratification. Stratification minimizes mixing between the zones, and is an important feature in the stratified chilled water storage tank. The stratification (i.e. separation of temperate zones) tends to remain in effect so long as the body of water is not disturbed by water turbulence or an uneven flow of water.

In the stratified chilled water storage tank the warm upper zone and the cool lower zone are separated by a thermocline. The thermocline is a relatively thin layer of water. Within this layer, there is a rapid decrease in temperature with respect to depth. The thin depth of the thermocline is an important feature in the stratified chilled water storage tank. The thermocline separates the temperature zones, and tends to remain thin so long as the body of water is not disturbed by water turbulence or an uneven flow of water.

The body of water in the stratified chilled water storage tank may become subject to water turbulence or an uneven flow of water when water is transferred into or out of the tank. The tank transfers the warm water or the cool water into or out of the tank, based on needs outside the tank, such as for a plant cooling system. The tank typically transfers water in and out by using a water diffuser.

The water diffuser typically comprises a pair of opposed arrangements of multiple pipe sections, one adjacent the top of the tank and one adjacent the bottom of the tank. Each pipe section contains at least one opening through its wall. Each pipe section typically contains a plurality of these openings. The opening(s) allow water to pass between the interior of each pipe section and the body of water in the tank. The water diffuser reduces water turbulence and uneven flows in a tank by controlling the nature, direction and distribution of water flow as water is transferred into and out of the tank.

There are several common pipe arrangements for water diffusers in stratified chilled water storage tanks. In cylindrical tanks, water diffusers are commonly arranged so that the plurality of pipes form an octagon shape. The octagon arrangement is an attempt to approximate the round shape of a typical cylindrical tank. In a typical octagon-shaped design a set of four distribution pipes, which carry the water to be diffused into the tank, are equally spaced throughout the octagon-shaped diffuser so every other diffuser pipe section has a distribution pipe directly feeding it, while the remaining diffuser pipe sections do not. Therefore, in order for the water to reach those pipe sections in the plurality that are not directly connected to a distribution pipe, the fluid must travel through a forty-five degree turn. Although an octagon design closely approximates the round shape of a cylindrical tank, an octagon requires several pipe sections and pipe turns. Octagonal designs are not ideal because they create water turbulence within the diffuser pipe sections and uneven distribution into the tank.

BRIEF SUMMARY OF THE INVENTION

In one embodiment, the present invention is an apparatus for diffusing a first fluid into a body of a second fluid. The apparatus comprises a tank, which contains the body of the second fluid, a plurality of pipe diffuser sections, wherein all of the pipe diffuser sections are at least partially submerged in the body of the second fluid, and a plurality of distribution pipes, the number of distribution pipes being equal to the number of pipe diffuser sections. The number of pipe diffuser sections and corresponding sides of the polygonal shape is no less than three and no more than seven. The pipe diffuser sections are arranged so that they form a substantially polygonal shape wherein the number of sides of the substantially polygonal shape is equal to the number of pipe sections. Each pipe diffuser section includes at least one wall, which includes at least one opening, which allows the first fluid to diffuse through the wall. Each one of the distribution pipes is connected to a pipe diffuser section by a connection, which allows the first fluid to flow from each distribution pipe into the pipe section. In another embodiment of the present invention, the invention is a method for diffusing a first fluid into a body of a second fluid contained in a tank. Pipe diffuser sections are configured to form a substantially polygonal shape, the number of pipe diffuser sections being no less than three and no more than seven. The first fluid is pumped through the pipe diffuser sections so that, along the entire length of each pipe diffuser section, the flow path of the first fluid remains substantially linear from a point that the first fluid enters the pipe diffuser sections to a point that the first fluid exits the pipe diffuser section by diffusion. The first fluid is then diffused through at least one opening in a wall of the pipe diffuser section.

While the above-identified drawings set forth several embodiments of the invention, other embodiments are also contemplated, as noted in the discussion. In all cases, this disclosure presents the invention by way of representation and not limitation. It should be understood that numerous other modifications and embodiments can be devised by those skilled in the art which fall within the scope and spirit of the principals of this invention. The figures may not be drawn to scale.

DETAILED DESCRIPTION

Figure 1:
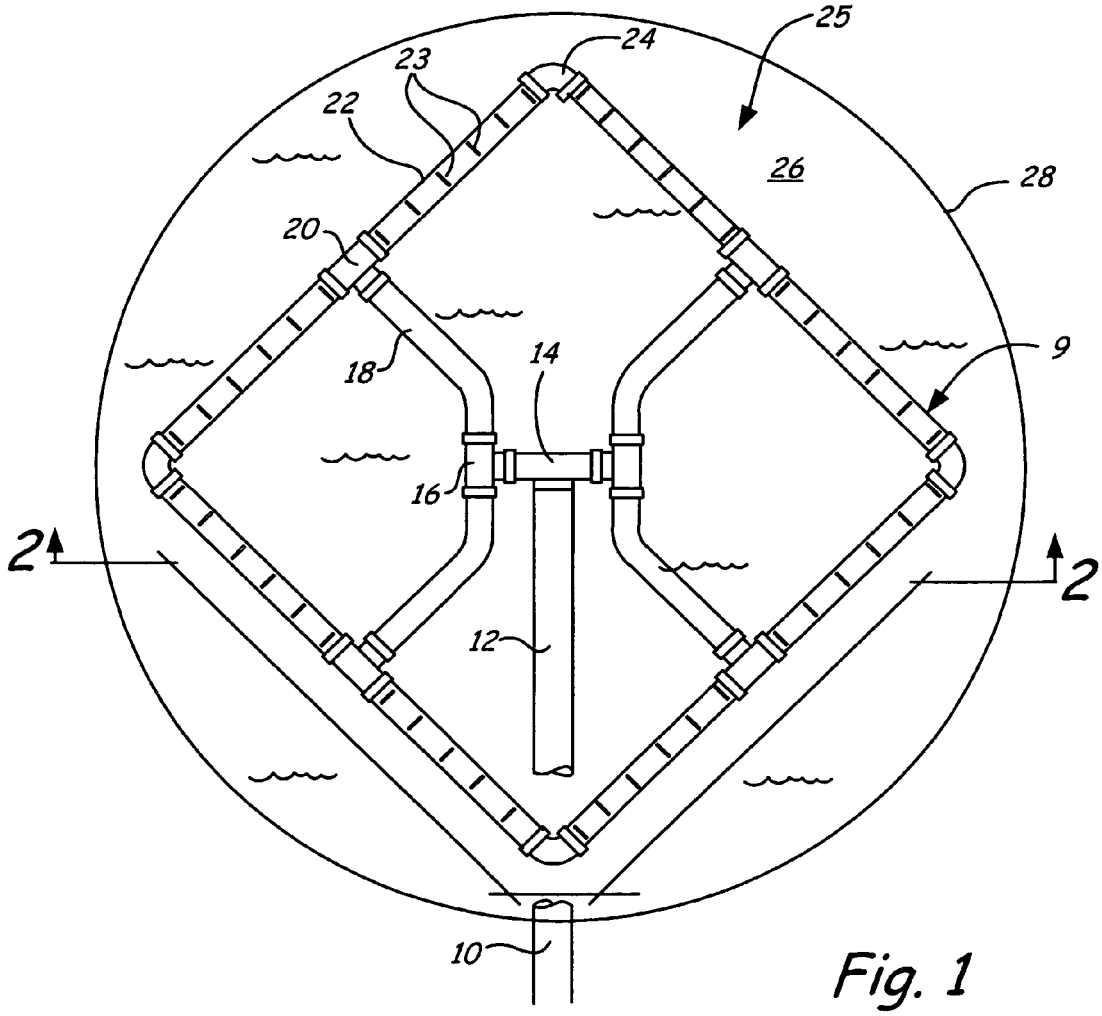
FIG. 1 is a top view of a first, square embodiment of a polygon shaped fluid diffuser in a cylindrical tank of fluid.

FIG. 1 is a top view of a first, square embodiment of polygon shaped fluid diffuser 9 in a cylindrical tank 28 of fluid. Diffuser 9 includes outside pipe 10, main pipe 12, splitter 14, distribution splitters 16, distribution pipes 18, diffuser splitters 20, pipe diffuser sections 22, and corner connectors 24. Outside pipe 10 connects to main pipe 12, which enters splitter 14. Splitter 14 connects to distribution splitters 16, which branch into distribution pipes 18. Distribution pipes 18 connect to diffuser splitters 20, which connect to pipe diffuser sections 22. FIG. 1 shows a broken connection between outside pipe 10 and main pipe 12, to provide a full view of pipe diffuser sections 22. Each pipe diffuser section 22 contains openings 23 through its walls. Pipe diffuser sections 22 are submerged in body of fluid 26, which is contained in cylindrical tank 28.

Fluid is diffused by transferring fluid from outside pipe 10 into body of fluid 26. Fluid flows from outside pipe 10 through main pipe 12, splitter 14, distribution splitters 16, distribution pipes 18, diffuser splitters 20 and into pipe diffuser sections 22. The fluid then flows through the length of pipe diffuser sections 22. Fluid pressure forces the fluid to diffuse through openings 23 in the walls of pipe diffuser sections 22 and into body of fluid 26.

One of the benefits of the present invention is the ability to provide even, uniform and non-turbulent fluid diffusion into a body of fluid. The first, square diffuser embodiment shown in FIG. 1 provides even fluid diffusion at least in part because both diffuser splitters 20 and openings 23 are evenly distributed along the length of pipe diffuser sections 22. Pipe diffuser sections 22 are arranged in square shape 25 which approximates the size and shape of cylindrical tank 28. The most uniform fluid diffusion may be obtained when the cross-sectional area within square shape 25 is equal to the cross-sectional area between the outside of square shape 25 and the inside walls of cylindrical tank 28. The first, square embodiment provides non-turbulent fluid diffusion because pipe diffuser sections 22 do not require fluid to flow through any pipe turns from diffuser splitters 20 (where the fluid enters pipe diffuser sections 22) to any of openings 23 (where the fluid diffuses into the body of fluid 26).

The first, square embodiment connects pipe diffuser sections 22 together with corner connectors 24 to provide extra rigidity in the overall apparatus. Corner connectors 24 are not required for effective fluid diffusion. Alternatively, any or all of pipe diffuser sections 22 may be capped at one or more of their ends. A capped pipe diffuser section 22 may or may not be structurally connected to another pipe diffuser section 22.

The first, square embodiment utilizes standard pipe fittings to minimize the cost of the overall apparatus. Splitter 14 and distribution splitters 16 are standard T-shaped pipe fittings. Square shape 25 allows diffuser splitters 20 to also be standard T-shaped pipe fittings. Square shape 25 only requires each of distribution pipes 18 to make a single forty-five degree turn, which may be done with a standard forty-five degree pipe fitting.

Figure 2:
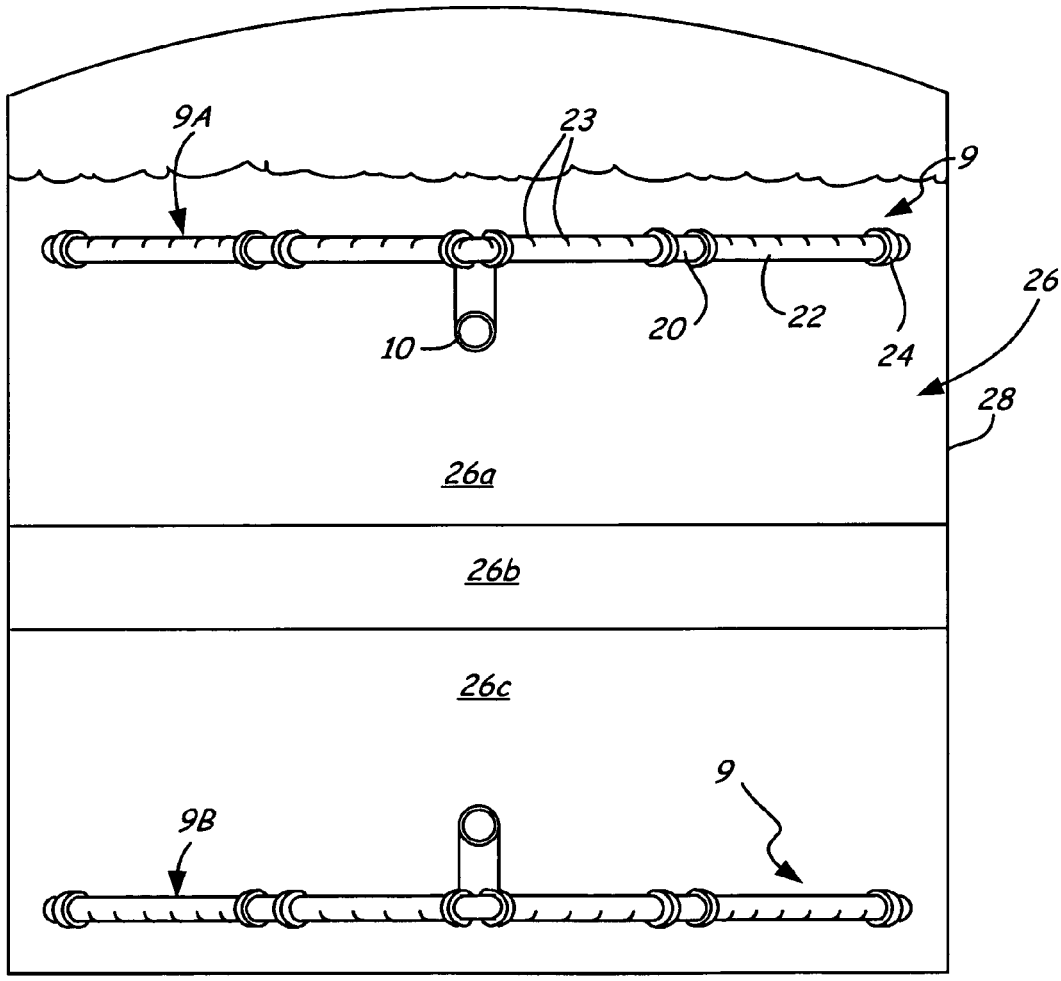
FIG. 2 is a sectional view taken along line 2-2 of FIG. 1 of the first, square embodiment of the polygon shaped fluid diffuser in the cylindrical tank of fluid.

FIG. 2 is a side sectional view taken along line 2-2 of FIG. 1 of the first, square embodiment of polygon shaped fluid diffuser 9, in two orientations (upper diffuser 9A and lower diffuser 9B), in body of fluid 26 within cylindrical tank 28. FIG. 2 illustrates the thermal stratification in body of fluid 26, with separate regions including warm fluid zone 26*a*, thermocline 26*b*, and cool fluid zone 26*c*. In one exemplary embodiment, body of fluid 26 is water and cylindrical tank 28 is a stratified chilled water storage tank. Body of fluid 26 includes three temperate zones: warm fluid zone 26*a* occupies the upper portion of cylindrical tank 28, cool fluid zone 26*c* occupies the lower portion of cylindrical tank 28, and thermocline 26*b* separates warm fluid zone 26*a* and cool fluid zone 26*c*. In this view, openings 23 appear curved because pipe diffuser sections 22 are shown as round pipes. Alternatively, pipe diffuser sections 22 may be formed in other shapes.

In operation, warm fluid may be introduced into tank 28 via upper diffuser 9A while cold fluid is withdrawn from tank 28 via lower diffuser 9B. As that happens, warm fluid zone 26*a* gets larger as more warm fluid is introduced into tank 28, while cool fluid zone 26*c* gets smaller as cool fluid is withdrawn from tank 28. Consequently, thermocline 26*b* moves downward within tank 28. The volume of body of fluid 26 in tank 28 remains essentially the same, but the ratio of the amount of warm fluid with respect to cold fluid is changed (i.e., the ratio gets larger). The inventive diffuser arrangement allows smooth introduction and withdrawal of fluid relative to body of fluid 26, without turbulence, so that thermocline 26*b* is not disturbed and the separation between warm fluid zone 26*a* and cool fluid zone 26*c* is maintained. In reverse operation, cold fluid is introduced into tank 28 via lower diffuser 9B and warm fluid is withdrawn from tank 28 via upper diffuser 9A. In that case, the change in relationships (and volume ratios) is reversed, and thermocline 26*b* moves upwardly in tank 28 as the thermal composition of body of fluid 26 in tank 28 changes over time.

Turbulence is minimized and laminar flow is enhanced because once the fluid is introduced into a diffuser pipe section (such as pipe diffuser section 22), the fluid is diffused from the pipe diffuser without the need for flowing through any further pipe bends before diffusion (i.e., the pipe diffuser sections are straight). By providing a substantially linear path for the fluid to travel, turbulence is minimized. The term "substantially linear" should be understood to include not only paths that are straight, but also paths that may have slight turns but do not result in the formation of a significant amount of turbulence. In addition, the diffuser is designed to be as symmetrical as possible relative to the tank's shape, which contributes to even fluid diffusion into and out of pipe diffuser sections 22 via their openings 23.

Figure 3:
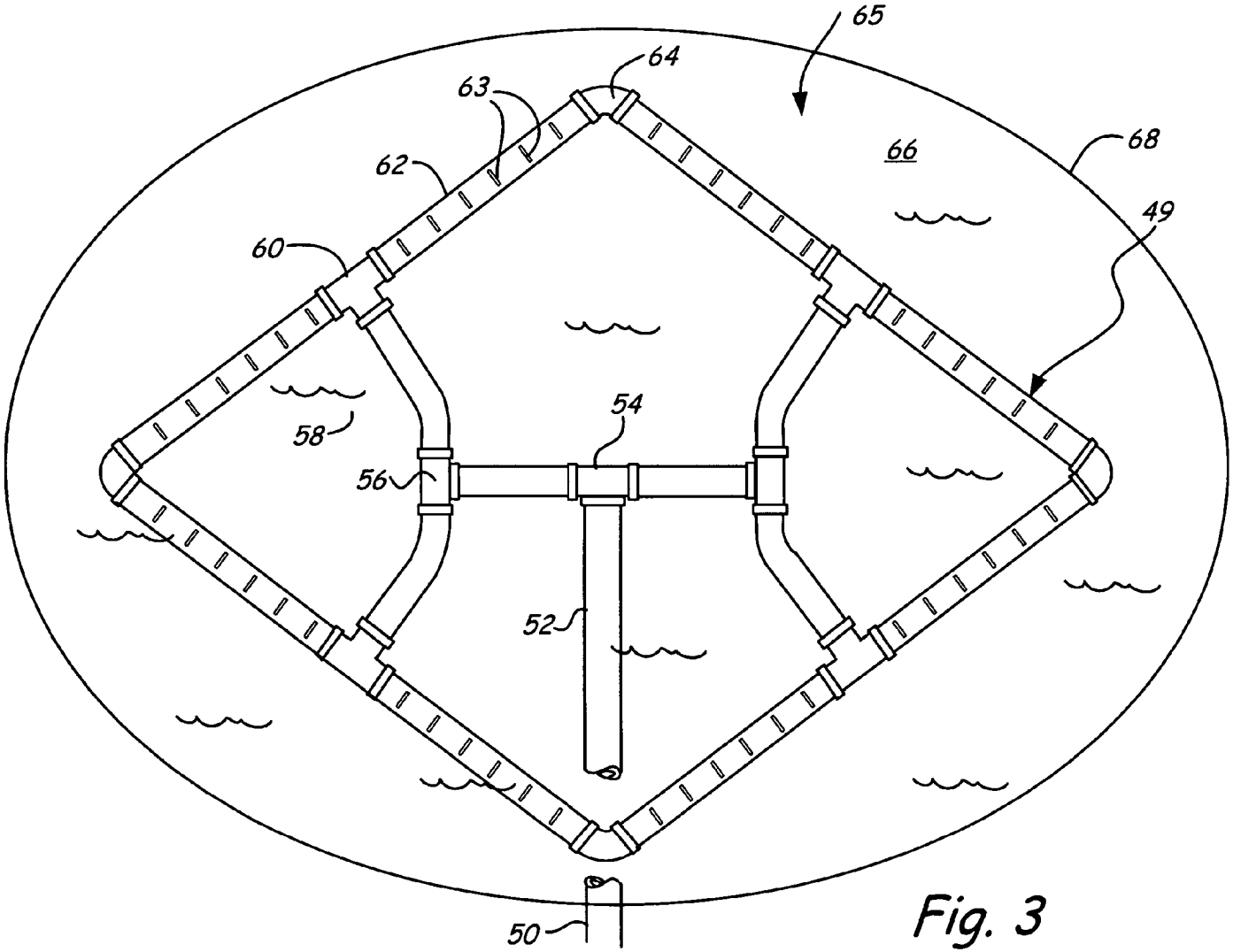
FIG. 3 is a top view of a second, parallelogram-shaped embodiment of the polygon shaped fluid diffuser, in an elliptical tank of fluid.

FIG. 3 is a top view of a second, parallelogram-shaped embodiment of polygon shaped fluid diffuser 49, in a tank of fluid having an elliptical cross-section. Diffuser 49 includes outside pipe 50, main pipe 52, splitter 54, distribution splitters 56, distribution pipes 58, diffuser splitters 60, pipe diffuser sections 62, and corner connectors 64. Pipe diffuser sections 62 are arranged in parallelogram-shape 65 within body of fluid 66 in elliptical tank 68. Pipe diffuser sections 62 have openings 63 for allowing fluid flow in and out of pipe diffuser sections 62, relative to body of fluid 66. Operation of the third, parallelogram-shaped embodiment of polygon shaped fluid diffuser 49 (shown in FIG. 3) is similar to that described above with respect to FIGS. 1 and 2.

Figure 4:
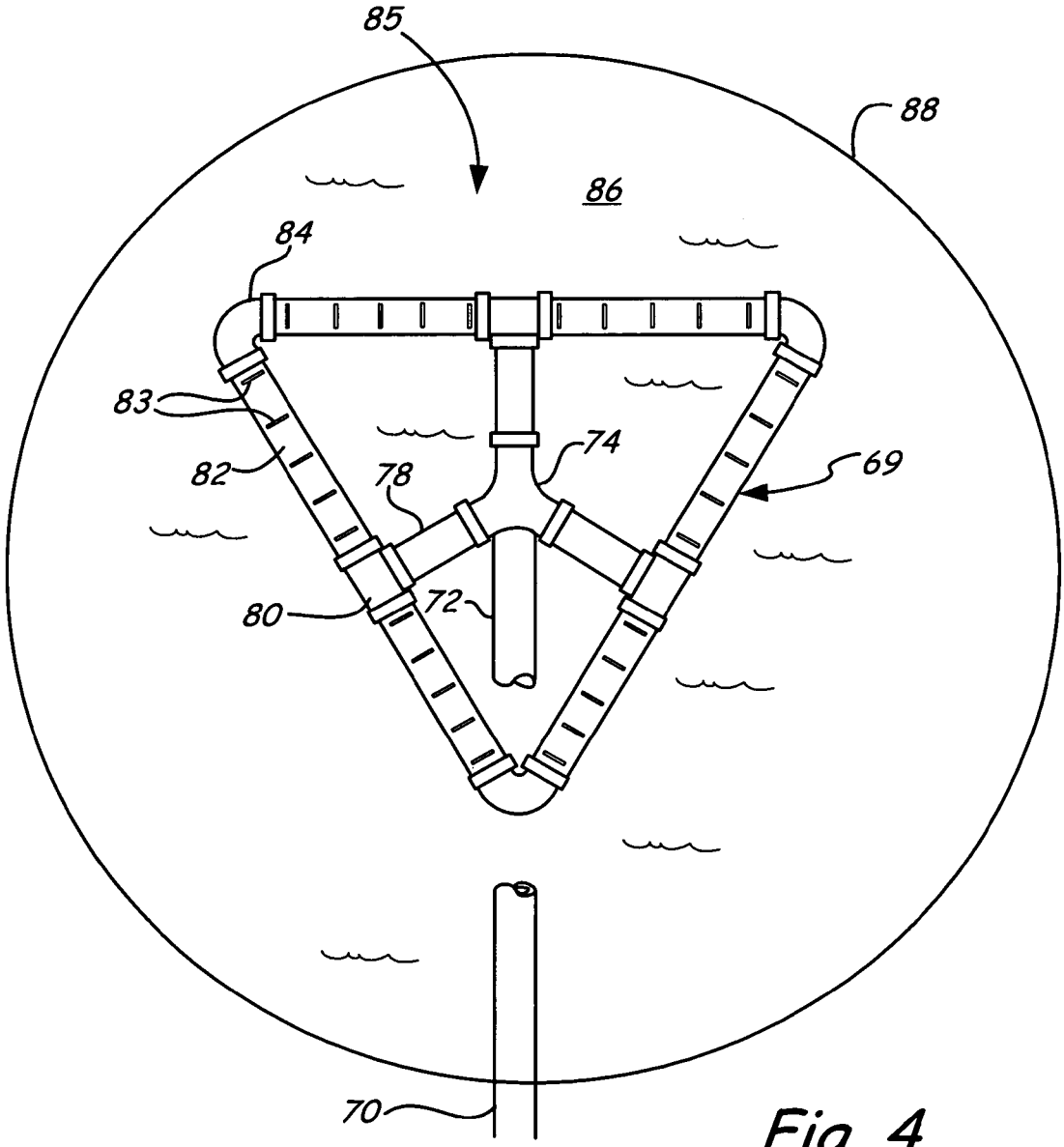
FIG. 4 is a top view of a third, triangular embodiment of the polygon shaped fluid diffuser, in a cylindrical tank of fluid.

FIG. 4 is a top view of a third, triangular embodiment of polygon shaped fluid diffuser 69, in a cylindrical tank of fluid. Diffuser 69 includes outside pipe 70, main pipe 72, splitter 74, distribution pipes 78, diffuser splitters 80, pipe diffuser sections 82, and corner connectors 84. Pipe diffuser sections 82 are arranged in triangular shape 85 in body of fluid 86 in cylindrical tank 88. Pipe diffuser sections 82 have openings 83 to permit fluid flow in and out of pipe diffuser sections 82, relative to body of fluid 86. Operation of the fourth, triangular embodiment of polygon shaped fluid diffuser 69 (shown in FIG. 4) is similar to that described above with respect to FIGS. 1 and 2.

Figure 5:
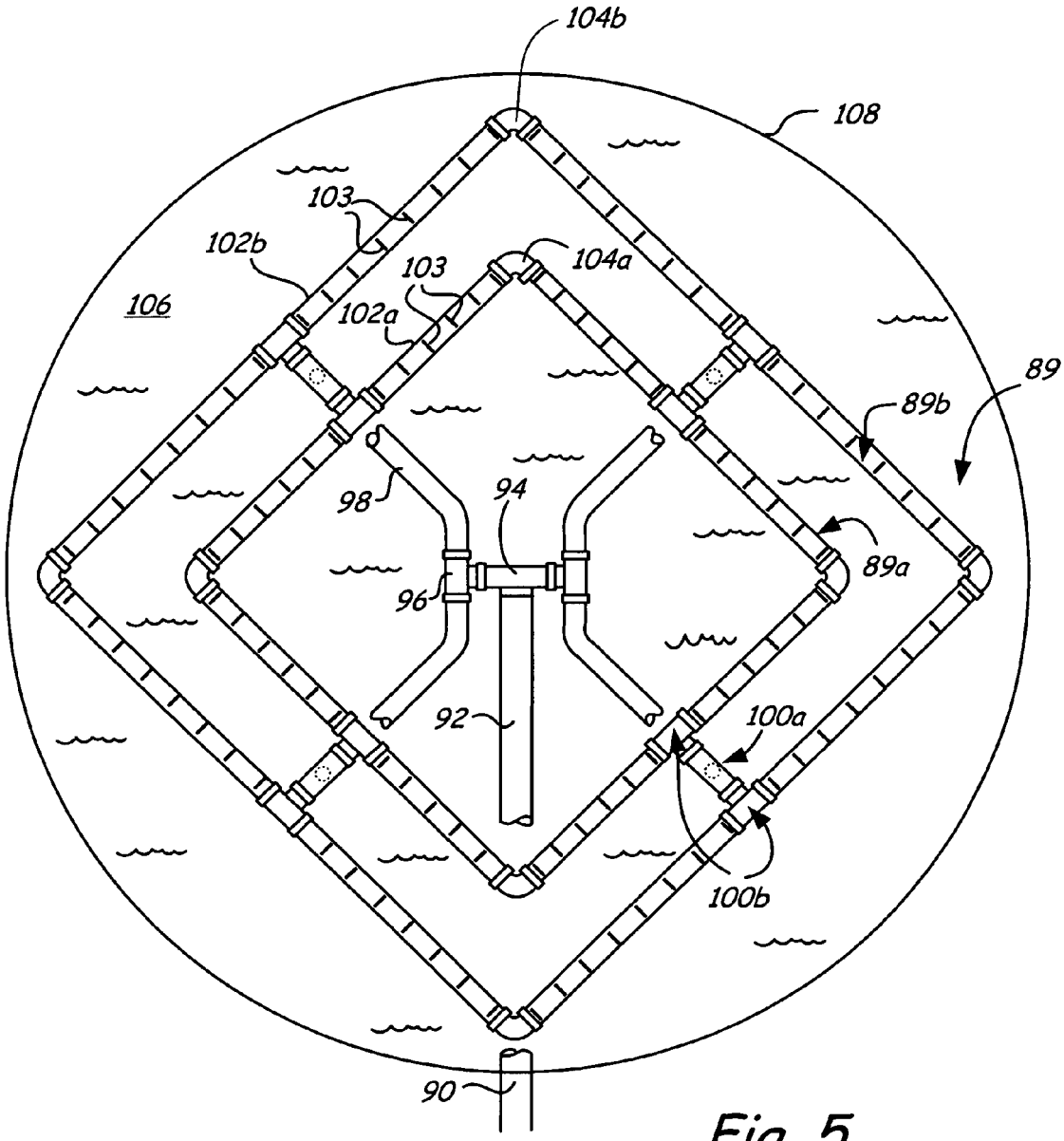
FIG. 5 is a top view of a fourth, nested parallelogram-shaped embodiment of the polygon shaped fluid diffuser, in a cylindrical tank of fluid.

FIG. 5 is a top view of a fourth, nested square-shaped embodiment of polygon shaped fluid diffuser 89, in a cylindrical tank of fluid. Diffuser 89 includes outside pipe 90, main pipe 92, splitter 94, distribution splitters 96, distribution pipes 98, splitter 100*a*, diffuser splitter 100*b*, inside pipe diffuser sections 102*a*, outside pipe diffuser sections 102*b*, inside corner connectors 104*a* and outside corner connectors 104*b*. Outside pipe diffuser sections 102*b* are arranged in a square-shape. Inside pipe diffuser sections 102*a* are shorter than outside pipe diffuser sections 102*b*, and are likewise arranged in a square-shape. Adjacent inside pipe diffuser sections 102*a* and outside pipe diffuser sections 102*b* are parallel. Diffuser 89 thus has inner diffuser 89*a* defined by inside pipe diffuser sections 102*a*, and outer diffuser 89*b* defined by outside pipe diffuser sections 102*b*. Diffuser 89 is disposed in body of fluid 106 in cylindrical tank 108. Pipe diffuser sections 102*a* and 102*b* have openings 103 to permit fluid flow in and out of pipe diffuser sections 102*a* and 102*b*, relative to body of fluid 106.

One of the benefits of the nested square-shaped embodiment shown in FIG. 5 is the potential to diffuse a greater volume of fluid into body of fluid 106 contained in cylindrical tank 108. By positioning inner diffuser 89*a* within outer diffuser 89*b*, the total length of diffuser 89 is greatly increased, thereby increasing the total area of pipe available for diffusion.

Although not shown for the embodiments of FIGS. 3-5, the diffuser includes opposed pairs of diffusers in each embodiment, one adjacent the bottom of its respective tank, and one adjacent the top of its respective tank (such as illustrated by diffusers 9A and 9B in FIG. 2, for the first diffuser embodiment of FIG. 1).

Figure 6:
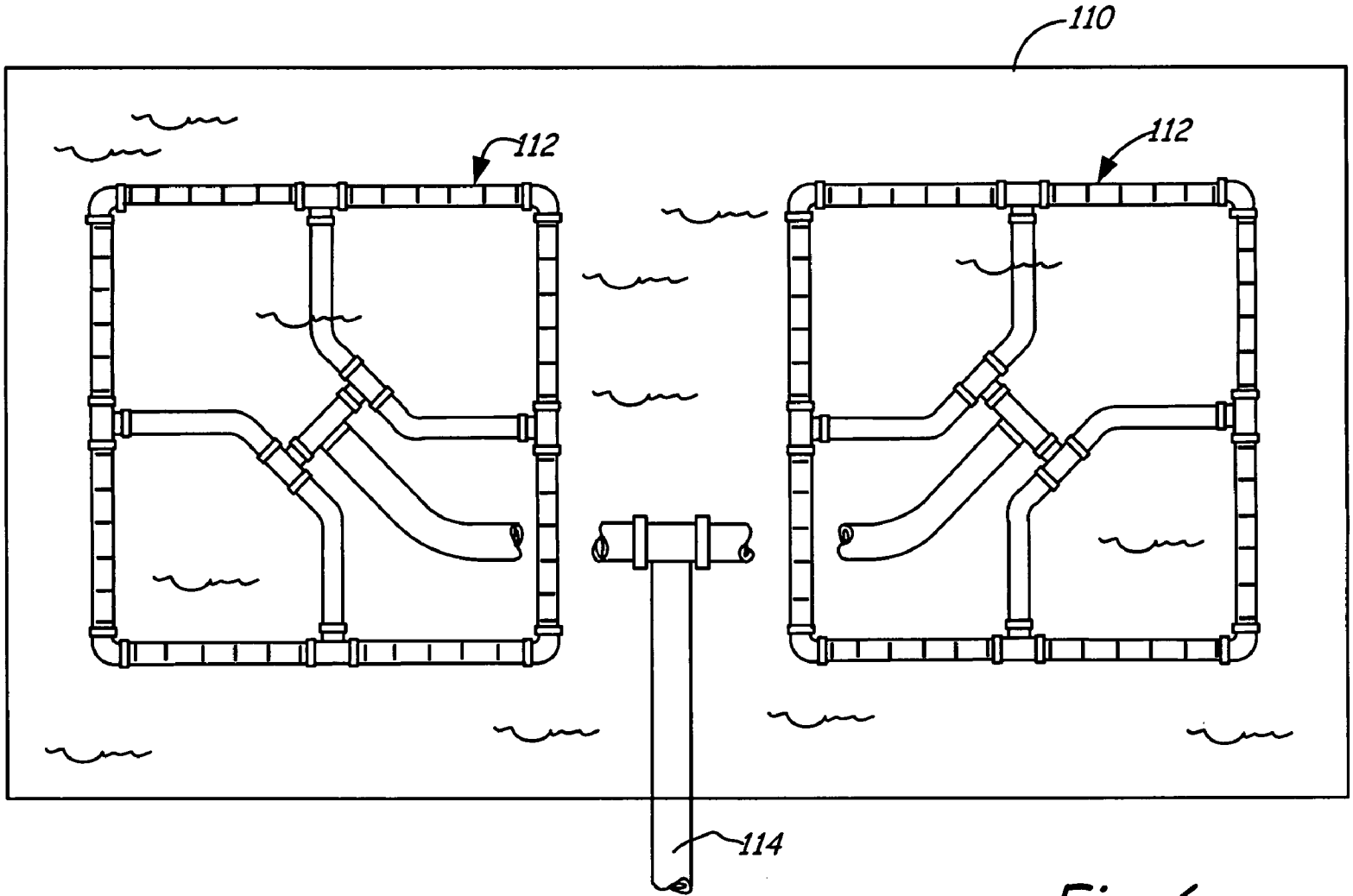
FIG. 6 is a top view of a fifth embodiment of the polygon shaped fluid diffuser (with two square embodiment diffusers), in a rectangular tank of fluid.

In alternative embodiments, more than one diffuser structure maybe aligned on the same plane in a tank. For instance, FIG. 6 illustrates rectangular tank 110 with a pair of square diffusers 112 therein, which may be connected to a single outside pipe 114, via suitable fluid distribution connections. As noted above, similarly shaped diffusers would be located in a tank at vertically-spaced planes adjacent the top and bottom of the tank. Thus, upper and lower dual diffuser arrangements such as shown in FIG. 6 would be provided in a tank.

While the foregoing describes and depicts polygon-shaped fluid diffusers with only three or four sides, polygon-shaped fluid diffusers with five, six, or seven sides (and five, six, or seven distribution pipes, respectively) may also be used while achieving at least some of the benefits provided by the embodiments described above.

As described above the present invention provides even, uniform and non-turbulent fluid diffusion into a body of fluid. This type of diffusion is possible using a polygon-shaped fluid diffuser arrangement wherein the number of pipe diffuser sections is no less than three and no more than seven, and each pipe diffuser section is directly connected to one distribution pipe. A common existing pipe arrangement for a water diffuser in a cylindrical stratified chilled water storage tank is an octagon-shaped arrangement, such as the one shown in FIG. 7.

Figure 7:
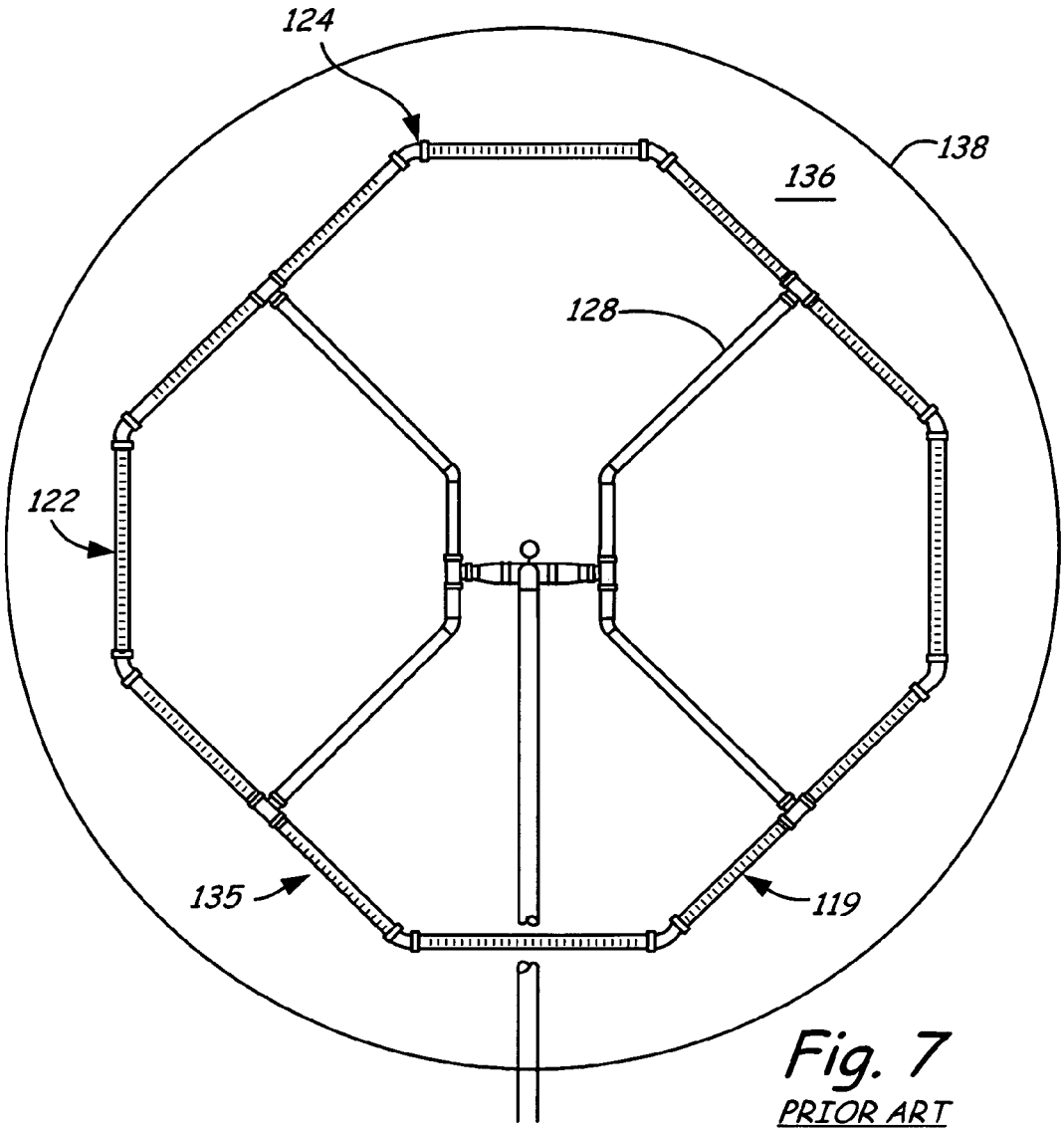
Fig. 7 PRIOR ART
FIG. 7 is a top view of a prior art octagon-shaped fluid diffuser, in a cylindrical tank of fluid.

FIG. 7 is a top view of octagon-shaped fluid diffuser 119, in a cylindrical tank of fluid. This embodiment is representative of the common octagon arrangement of the prior art. Diffuser 119 includes pipe diffuser sections 122, pipe turns 124, and distribution pipes 128. Pipe diffuser sections 122 are arranged in octagonal shape 135 within body of fluid 136 in cylindrical tank 138. As can be seen in FIG. 7, octagon-shaped diffuser 119 includes four distribution pipes 128. Therefore, no two adjacent pipe diffuser sections 122 are fed directly by distribution pipes 128. In order for a first fluid to reach one of pipe diffuser sections 122 that is not directly connected to one of the four distribution pipes 128, the fluid must travel through pipe turn 124 between two pipe diffuser sections 122. It is not desirable for the fluid to travel through pipe turns 124 for several reasons. First, pipe turns 124 cause flow to become turbulent, which negatively impacts the ability to diffuse the fluid. Second, pipe turns 124 create a pressure drop in a system, where the pressure is greater prior to the turn in the pipe. Because of the change in pressure, more fluid is diffused before the turn than after, which creates an uneven distribution of fluid diffused into tank 138.

Although an octagon design more closely approximates the round shape of a cylindrical tank than a polygon design with fewer sides, an octagon requires more pipe diffuser sections and more pipe turns. Because more pipe diffuser sections are used in an octagon design, the length of these pipe diffuser sections is necessarily shorter than the length of pipes possible in a polygon design with fewer sides. Furthermore, the octagonal designs of the prior art do not contain one distribution pipe for every pipe diffuser section forming the octagon. Because one distribution pipe serves more than one pipe diffuser section, the fluid must go through a pipe turn before it is diffused into the tank. Octagonal designs are not ideal because they create water turbulence within the pipe diffuser sections due to the pipe turns. Consequently, reducing the number of sides in the diffuser design is advantageous because the maximum length of each pipe diffuser section is increased and the number of pipe turns is reduced, therefore minimizing the turbulence within the diffuser and creating a more even distribution of diffused fluid within the tank.

The diffuser of the present invention provides even, uniform, and non-turbulent fluid diffusion into a body of fluid. The design of the present invention includes long pipe sections, few pipe turns, and distribution pipes equal in number to the number of sides of the polygon design formed by the pipe sections. Turbulence is minimized and laminar flow is enhanced because once the fluid is introduced into the long pipe sections, the fluid is diffused from the pipe sections without the need for flowing through any pipe bends before diffusion.

Although the present invention has been described with reference to preferred embodiments, workers skilled in the art will recognize that changes may be made in form and detail without departing from the spirit and scope of the invention.

The invention claimed is:

1. An apparatus for diffusing a first fluid into a body of a second fluid, comprising:

a tank containing the body of the second fluid;

a plurality of pipe diffuser sections at least partially submerged in the body of the second fluid in a substantially polygonal shape, the number of pipe diffuser sections and corresponding sides of the polygonal shape being no less than three and no more than seven, each pipe diffuser section containing at least one wall with at least one opening in the longitudinal axis of the at least one wall that allows the first fluid to diffuse through the wall into the second fluid; and a plurality of distribution pipes, the number of distribution pipes being equal to the number of pipe diffuser sections, wherein each of the distribution pipes is connected to a pipe diffuser section by one of a first set of connections, to allow the first fluid to flow from each distribution pipe into the pipe diffuser section.

2. The apparatus of claim 1 wherein the first fluid and the second fluid are water.

3. The apparatus of claim 2 wherein the tank is a stratified chilled water storage tank.

4. The apparatus of claim 1 wherein all of the pipe diffuser sections are equal in length.

5. The apparatus of claim 1 wherein the distance between any two adjacent connections of the first set of connections, when measured continuously along the sides of the substantially polygonal shape, is substantially equal.

6. The apparatus of claim 1 wherein the number of pipe diffuser sections is exactly four.

7. The apparatus of claim 6 wherein:

two of the pipe diffuser sections, which form opposite sides of the substantially polygonal shape, have a length equal to a first value; and the remaining two pipe diffuser sections have a length equal to a second value, which is different than the first value.

8. The apparatus of claim 1 wherein the plurality of pipe diffuser sections comprises an outer set of pipe diffuser sections, and further comprising:

an inner set of pipe diffuser sections at least partially submerged in the body of the second fluid in a second substantially polygonal shape similar to the outer set of pipe diffuser sections, and being concentric with the substantially polygonal shape of the outer set of pipe diffuser sections, the number of pipe diffuser sections in the inner set of pipe diffuser sections being equal to the number of pipe diffuser sections in the outer set of pipe diffuser sections, each pipe diffuser section containing at least one wall with at least one opening in the longitudinal axis of the at least one wall that allows the first fluid to diffuse through the wall into the second fluid; and wherein each of the distribution pipes is connected to a pipe diffuser section of the inner set of pipe diffuser sections by one of a second set of connections, to allow the first fluid to flow from each distribution pipe into the pipe diffuser section of the inner set of pipe diffuser sections.

9. An apparatus for diffusing a first fluid into a body of a second fluid, comprising:

a tank containing the body of the second fluid;

four pipe diffuser sections at least partially submerged in the body of the second fluid, each pipe diffuser section containing at least one wall with at least one opening in the longitudinal axis of the at least one wall that allows the first fluid to diffuse through the wall into the second fluid; and four distribution pipes, wherein each of the four distribution pipes is connected to a pipe diffuser section by one of a first set of connections, to allow the first fluid to flow from each distribution pipe into the pipe diffuser section.

10. The apparatus of claim 9 wherein the first fluid and the second fluid are water.

11. The apparatus of claim 10 wherein the tank is a stratified chilled water storage tank.

12. The apparatus of claim 9 wherein:

two of the pipe diffuser sections, which are parallel to one another, have a length equal to a first value; and the remaining two pipe diffuser sections have a length equal to a second value, which is different than the first value.

13. The apparatus of claim 9 wherein all of the pipe diffuser sections are equal in length.

14. The apparatus of claim 9 wherein the distance between any two adjacent connections of the first set of connections is substantially equal.

15. The apparatus of claim 9 wherein the four pipe diffuser sections form an outer set of pipe diffuser sections, and further comprising:

an inner set of four pipe diffuser sections at least partially submerged in the body of the second fluid, the inner set of pipe diffuser sections being geometrically similar to the outer set of pipe diffuser sections, and being concentric with the outer set of pipe diffuser sections, each pipe diffuser section containing at least one wall with at least one opening in the longitudinal axis of the at least one wall that allows the first fluid to diffuse through the wall into the second fluid; and wherein each of the four distribution pipes is connected to a pipe diffuser section of the inner set of four diffuser pipe sections by one of a second set of connections, to allow the first fluid to flow from each distribution pipe into the pipe diffuser section of the inner set of four pipe sections.

16. A method for diffusing a first fluid into a body of a second fluid contained in a tank, the method comprising:

configuring pipe diffuser sections to form a substantially polygonal shape, the number of pipe diffuser sections being no less than three and no more than seven;

pumping the first fluid through pipe diffuser sections so that, along the entire length of each pipe diffuser section, the flow path of the first fluid remains substantially linear from a point that the first fluid enters the pipe diffuser section to a point that the first fluid exits the pipe diffuser section by diffusion; and diffusing the first fluid into the second fluid through at least one opening along a longitudinal axis in a wall of the pipe diffuser section.

17. The method of claim 16, wherein the step of diffusing the first fluid into the body of the second fluid comprises diffusing water.

18. The method of claim 17, wherein the step of diffusing the first fluid into the body of the second fluid contained in the tank comprises diffusing the first fluid into a stratified chilled water storage tank.

19. The method of claim 16 wherein the step of configuring the pipe diffuser sections comprises forming the substantially polygonal shape with exactly four pipe diffuser sections.

20. The method of claim 16 wherein the step of configuring the pipe diffuser sections comprises forming the substantially polygonal shape with pipe diffuser sections that are all equal in length.

* * * * *

UNITED STATES PATENT AND TRADEMARK OFFICE

CERTIFICATE OF CORRECTION

PATENT NO. : 7,284,747 B2
APPLICATION NO. : 10/900520
DATED : October 23, 2007
INVENTOR(S) : Lon W. Fiedler et al.

It is certified that error appears in the above-identified patent and that said Letters Patent is hereby corrected as shown below:

Column 5, Line 46, delete “maybe”, insert --may be--

Signed and Sealed this

Eleventh Day of March, 2008

JON W. DUDAS
*Director of the United States Patent and Trademark Office*